US008704629B2

(12) United States Patent
Ogawa et al.

(10) Patent No.: US 8,704,629 B2
(45) Date of Patent: Apr. 22, 2014

(54) COIL-TYPE ELECTRONIC COMPONENT AND ITS MANUFACTURING METHOD

(75) Inventors: Hideki Ogawa, Takasaki (JP); Atsushi Tanada, Takasaki (JP); Hitoshi Matsuura, Takasaki (JP); Kiyoshi Tanaka, Takasaki (JP); Hiroshi Kishi, Takasaki (JP); Kenji Kawano, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/348,926

(22) Filed: Jan. 12, 2012

(65) Prior Publication Data

US 2012/0119871 A1 May 17, 2012

Related U.S. Application Data

(63) Continuation of application No. 13/092,381, filed on Apr. 22, 2011.

(30) Foreign Application Priority Data

Apr. 30, 2010 (JP) ..... 2010-105552
Apr. 18, 2011 (JP) ..... 2011-091879

(51) Int. Cl.

| | |
|---|---|
| ***H01F 27/24*** | (2006.01) |
| ***H01F 27/02*** | (2006.01) |
| ***H01F 5/00*** | (2006.01) |
| ***H01F 17/04*** | (2006.01) |
| ***H01F 7/06*** | (2006.01) |

(52) U.S. Cl.

USPC ..... 336/233; 336/83; 336/200; 336/221; 336/234; 29/602.1

(58) Field of Classification Search

USPC ..... 336/221, 233, 83, 234; 29/602.1
See application file for complete search history.

(56) References Cited

U.S. PATENT DOCUMENTS 4,129,444 A 12/1978 Dreyer et al.
5,522,946 A 6/1996 Tomita et al.

(Continued)

FOREIGN PATENT DOCUMENTS

CN 101308719 A 11/2008
CN 101927344 A 12/2010

(Continued)

OTHER PUBLICATIONS

Non-Final Rejection issued by U.S. Patent and Trademark Office, dated May 7, 2013, for related U.S. Appl. No. 13/092,381.

(Continued)

*Primary Examiner* — Tsz Chan
(74) *Attorney, Agent, or Firm* — Law Office of Katsuhiro Arai

(57) ABSTRACT

A coil-type electronic component has a coil inside or on the surface of its base material and is characterized in that: the base material is constituted by a group of grains of a soft magnetic alloy containing iron, silicon and other element that oxidizes more easily than iron; the surface of each soft magnetic alloy grain has an oxide layer formed on its surface as a result of oxidization of the grain; this oxide layer contains the other element that oxidizes more easily than iron by a quantity larger than that in the soft magnetic alloy grain; and grains are bonded with one another via this oxide layer.

12 Claims, 7 Drawing Sheets

(56) References Cited

U.S. PATENT DOCUMENTS

| | | | | |
|---|---|---|---|---|
| 6,392,525 | B1 | 5/2002 | Kato et al. | |
| 6,764,643 | B2 | 7/2004 | Sagawa et al. | |
| 6,784,782 | B2 | 8/2004 | Inoue et al. | |
| 6,814,928 | B2 | 11/2004 | Sagawa et al. | |
| 7,422,697 | B2 | 9/2008 | Takahashi et al. | |
| 7,446,638 | B2 | 11/2008 | Nogi | |
| 8,018,313 | B2 | 9/2011 | Tada et al. | |
| 2004/0140016 | A1 * | 7/2004 | Sakamoto et al. | 148/304 |
| 2004/0209120 | A1 * | 10/2004 | Inoue et al. | 428/694 B |
| 2007/0290161 | A1 | 12/2007 | Tokuoka et al. | |
| 2008/0003126 | A1 | 1/2008 | Watanabe et al. | |
| 2008/0012679 | A1 | 1/2008 | Okabe et al. | |
| 2008/0029300 | A1 | 2/2008 | Harada et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2009/0045905 | A1 | 2/2009 | Nakagawa et al. | |
| 2009/0102589 | A1 | 4/2009 | Lee et al. | |
| 2010/0253463 | A1 | 10/2010 | Shimomura et al. | |
| 2010/0289609 | A1 | 11/2010 | Liao et al. | |
| 2011/0024670 | A1 | 2/2011 | Otsuki et al. | |
| 2011/0133881 | A1 | 6/2011 | Nakajima et al. | |
| 2011/0227690 | A1 | 9/2011 | Watanabe et al. | |
| 2012/0070567 | A1 | 3/2012 | Watanabe et al. | |

FOREIGN PATENT DOCUMENTS

| | | | | |
|---|---|---|---|---|
| JP | 07-201570 | A | | 8/1995 |
| JP | H09-074011 | A | | 3/1997 |
| JP | 2000-030925 | A | | 1/2000 |
| JP | 2001-011563 | A | | 1/2001 |
| JP | 2001-118725 | A | | 4/2001 |
| JP | 2002-305108 | A | | 10/2002 |
| JP | 2002-313620 | A | | 10/2002 |
| JP | 2002-343618 | A | | 11/2002 |
| JP | 2007-019134 | A | | 1/2007 |
| JP | 2007-027354 | A | | 2/2007 |
| JP | 2007-123703 | A | | 5/2007 |
| JP | 2007258427 | A | * | 10/2007 |
| JP | 2007-299871 | A | | 11/2007 |
| JP | 2008-028162 | A | | 2/2008 |
| JP | 2008-041961 | A | | 2/2008 |
| JP | 2008041961 | A | * | 2/2008 |
| JP | 2008-195986 | A | | 8/2008 |
| JP | 2009-088496 | A | | 4/2009 |
| JP | 2009-088502 | A | | 4/2009 |
| WO | 2009/128425 | A1 | | 10/2009 |
| WO | 2010/013843 | A1 | | 2/2010 |

OTHER PUBLICATIONS

Notification of Reasons for Refusal issued by the Japanese Patent Office, mailed May 29, 2013, for Japanese counterpart application No. 2011-170349.

International Search Report and Written Opinion of the International Searching Authority for International application No. PCT/JP2011/060106, dated Jul. 26, 2011.

International Search Report issued for International application No. PCT/JP2011/060106, dated Jul. 26, 2011.

Non-final Office action issued by the USPTO, dated Sep. 12, 2013, for copending U.S. Appl. No. 13/277,018.

Office Action issued by the Korean Patent Office, mailed Nov. 4, 2013, for Korean counterpart application of a related U.S. Appl. No. 13/092,381.

Non-final Office action issued by the USPTO, dated Oct. 18, 2013, for copending U.S. Appl. No. 13/642,467.

* cited by examiner (A)

(B)

$$\sigma b = \frac{M}{I} \times \frac{h}{2} = \frac{3WL}{2bh^2}$$

Width of test piece: b (mm)
Thickness of test piece: h (mm)
3-point bending rupture stress (σb)
Bending moment: M
Geometrical moment of inertia: I Electrode Layout in Resistivity Test Volume resistivity: ρV (Ωcm)
Outer diameter of inner circle of top-side electrode: d (cm)
Thickness of test piece: t (cm)
Volume resistance: Rv (Ω)

$$\rho_V = \frac{\pi d^2}{4t} \times R_V$$

COIL-TYPE ELECTRONIC COMPONENT AND ITS MANUFACTURING METHOD

CROSS-REFERENCE TO RELATED APPLICATIONS

This application is a continuation of U.S. patent application Ser. No. 13/092,381, filed Apr. 22, 2011, which claims priority to Japanese Patent Application No. 2010-105552, filed Apr. 30, 2010, and No. 2011-091879, filed Apr. 18, 2011, and the disclosure of which is herein incorporated by reference in its entirety.

BACKGROUND

1. Field of the Invention

The present invention relates to a coil-type electronic component and its manufacturing method. In particular, the present invention relates to a coil-type electronic component using a soft magnetic alloy suitable for coil-type electronic components that are made small enough to be mounted on the surfaces of circuit boards, as well as a manufacturing method for said coil-type electronic component.

2. Description of the Related Art

Traditionally ferrite cores, cores cut out from thin metal sheets, and compacted powder magnetic cores, are used as magnetic cores for choke coils subject to high frequencies.

Metal magnetic materials provide an advantage over ferrite in that they can achieve higher saturation magnetic flux densities. On the other hand, metal magnetic materials themselves have low insulation property and must be given insulation treatment.

Patent Literature 1 (Japanese Patent Laid-open No. 2001-11563) proposes compression-molding a mixture of Fe—Al—Si powder having surface oxide film with a binder, and then heat-treating the molded product in an oxidizing atmosphere. According to this patent literature, applying heat treatment in an oxidizing atmosphere allows for formation of an oxide layer (alumina) in areas where the insulation layer on the surface of alloy powder has broken during compression molding, thereby achieving a complex magnetic material offering good DC superimposition characteristics with small core loss.

Patent Literature 2 (Japanese Patent Laid-open No. 2007-27354) describes a laminated electronic component whose main ingredient is metal magnetic powder, wherein said laminated electronic component is produced by stacking a metal magnetic layer formed by metal magnetic paste containing glass, with conductive patterns formed by conductive paste containing silver or other metal, thereby forming coil patterns inside the laminate, and wherein this laminated electronic component had been sintered in a nitrogen atmosphere at a temperature of 400° C. or above.

The complex magnetic material described in Patent Literature 1 requires a large force at the time of compression molding because molding uses Fe—Al—Si powder having oxide film already formed on its surface.

This material also presents a problem in that it does not support further size reduction if applied to power inductors or other electronic components through which greater current must flow.

The laminated electronic component described in Patent Literature 2 presents a problem in that the production cost may increase because the metal magnetic grains must be coated uniformly with glass and a nitrogen atmosphere is required to control this coating process.

Any discussion of problems and solutions involved in the related art has been included in this disclosure solely for the purposes of providing a context for the present invention, and it should not be taken as an admission that any or all of the discussion were known at the time the invention was made.

SUMMARY

The present invention was developed in light of the aforementioned situations and provides a coil-type electronic component equipped with a magnetic material that can be produced at low cost and still offers both high magnetic permeability and high saturation magnetic flux density and also provides a manufacturing process thereof.

After earnest studies repeatedly carried out to achieve the aforementioned purposes, the inventors of the present invention found that, when grains of a soft magnetic alloy containing iron, silicon and other element that oxidizes more easily than iron were mixed with a binder and the mixture was molded, and the molded product was heat-treated in an oxidizing atmosphere to break down the binder while an oxide layer was formed by oxidizing the surface of soft magnetic alloy grains, then the magnetic permeability after heat treatment would become higher when compared to the magnetic permeability before heat treatment. The inventors also found that soft magnetic alloy grains were bonded with one another, via the oxide layer, in this molded product that had been given heat treatment.

The present invention, which was completed based on the aforementioned insights, is described below:

1) A coil-type electronic component having a coil inside or on the surface of its base material, wherein said coil-type electronic component is characterized in that:

the base material is constituted by a group of grains of a soft magnetic alloy (also referred to as "alloy grains" or "soft magnetic grains") containing iron, silicon and another element that oxidizes more easily than iron;

the surface of each soft magnetic alloy grain has an oxide layer formed on its surface as a result of oxidization of the grain;

this oxide layer contains the other element that oxidizes more easily than iron in a quantity larger than that in the soft magnetic alloy grain; and the grains are bonded with one another via this oxide layer.

2) A coil-type electronic component according to (1), characterized in that the oxide layer via which the soft magnetic grains are bonded with one another is thicker than an oxide layer other than the bonding oxide layer on the surface of the soft magnetic grains.

3) A coil-type electronic component according to (1), characterized in that the oxide layer via which the soft magnetic grains are bonded with one another is thinner than an oxide layer other than the bonding oxide layer on the surface of the soft magnetic grains.

4) A coil-type electronic component according to (1) or (2), characterized in that at least some of the soft magnetic grains are grains on which the oxide layer has a thickness of at least 50 nanometers.

5) A coil-type electronic component according to any one of (1) to (4), characterized in that the aforementioned oxide layer bonding the aforementioned grains has a single phase.

6) A coil-type electronic component according to any one of (1) to (5), characterized in that the aforementioned element that oxidizes more easily than iron is chromium.

7) A coil-type electronic component according to any one of (1) to (5), characterized in that the aforementioned element that oxidizes more easily than iron is aluminum.

8) A coil-type electronic component according to (6), characterized in that the aforementioned soft magnetic alloy has a composition of about 2 to about 8 percent by weight of chromium, about 1.5 to about 7 percent by weight of silicon, and about 88 to about 96.5 percent by weight of iron.

9) A coil-type electronic component according to (7), characterized in that the aforementioned soft magnetic alloy has a composition of about 2 to about 8 percent by weight of aluminum, about 1.5 to about 12 percent by weight of silicon, and about 80 to about 96.5 percent by weight of iron.

10) A coil-type electronic component according to any one of (1) to (9), characterized in that the average size of the soft magnetic grains based on arithmetic mean is 30 micrometers or less.

11) A coil-type electronic component according to any one of (1) to (10), characterized in that the aforementioned oxide layer includes in this order a first oxide layer where the content of the aforementioned iron component decreases while the content of the aforementioned element that oxidizes easily increases, and a second oxide layer where the content of the aforementioned iron component increases and the content of the aforementioned element that oxidizes easily also decreases, as viewed outwardly from the aforementioned alloy grain.

12) A coil-type electronic component according to (11), characterized in that the aforementioned first oxide layer, as viewed outwardly from the aforementioned alloy grain, has an inflection point with respect to the content of the aforementioned silicon.

13) A coil-type electronic component according to any one of (1) to (12), characterized in that the peak strength ratio of the element that oxidizes more easily than iron, relative to iron, in the oxide layer is higher than the peak strength ratio of the element that oxidizes more easily than iron, relative to iron, in the aforementioned grain, based on calculation by the ZAF method through energy diffusion X-ray analysis using a scanning electron microscope.

14) A coil-type electronic component according to any one of (1) to (13), characterized in that the aforementioned coil has its end electrically connected to a conductive film formed on the surface of the aforementioned base material.

15) A coil-type electronic component having a coil, wherein said coil-type electronic component is characterized in that:

its base material is constituted by a group of grains of a soft magnetic alloy;

the surface of each soft magnetic alloy grain has an oxide layer formed on its surface as a result of oxidization of the grains;

this oxide layer contains a quantity of a metal that oxidizes more easily than iron, which quantity is larger than that in the alloy grains;

the grains are bonded with one another via this oxide layer; and a coil conductor is formed inside this base material.

16) A coil-type electronic component according to (15), characterized in that the coil conductor forms conductive patterns and is sintered simultaneously with the base material.

17) A coil-type electronic component according to (15) or (16), characterized in that the metal that oxidizes more easily than iron in the oxide layer is chromium.

18) A coil-type electronic component according to (15) or (16), characterized in that the metal that oxidizes more easily than iron in the oxide layer is aluminum.

19) A method for manufacturing a coil-type electronic component having a coil provided in its base material, wherein said manufacturing method for a coil-type electronic component comprises:

a step to press a mixture of binder and soft magnetic alloy grains to obtain a molded product;

a step to heat-treat the molded product in an atmosphere containing oxygen to form an oxide layer on the surface of the soft magnetic alloy grains and bond the soft magnetic alloy grains with one another via the oxide layer to obtain a base material; and a step to provide a coil and electrodes for pulling out in the base material.

20) A method for manufacturing a coil-type electronic component having a coil provided in its base material, wherein said manufacturing method for a coil-type electronic component includes:

a step to form a mixture of binder and soft magnetic alloy grains into a sheet, form coil conductive patterns on this sheet, and stack sheets, each produced this way, on top of each other to obtain a molded product;

a step to heat-treat the molded product in an atmosphere containing oxygen to form an oxide layer on the surface of the soft magnetic alloy grains and bond the soft magnetic alloy grains with one another via the oxide layer to obtain a base material having a coil inside; and a step to provide electrodes to be pulled out of the base material.

21) A manufacturing method for a coil-type electronic component according to (19) or (20), characterized in that the aforementioned oxygen atmosphere is the standard atmosphere.

According to the present invention, an oxide layer formed by oxidizing each soft magnetic grain is used as an insulation layer for the grain, which makes it no longer necessary to mix resin or glass with soft magnetic grains beforehand for the purpose of insulation. There is no need, either, to apply high pressure at the time of molding compared to when Fe—Al—Si powder whose surface has been heat-treated beforehand is used.

Accordingly, the present invention provides a magnetic material that can be produced at low cost and still offers both high magnetic permeability and high saturation magnetic flux density.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are highly simplified for illustrative purposes and are not necessarily to scale.

Description of the Symbols

| | |
|---|---|
| 1: | Grain |
| 2: | Oxide layer |
| 3: | Void |
| 10, 10': | Base materials using a soft magnetic alloy for an electronic component |
| 11: | Drum-type core |
| 11a: | Winding center |
| 11b: | Flange part |
| 12: | Sheet-shaped core |
| 14: | External conductive film |
| 14a: | Baked conductive film layer |
| 14b: | Ni plating layer |
| 14c: | Sn plating layer |
| 15: | Coil |
| 15a: | Winding part |
| 15b: | End (joined part) |
| 20: | Electronic component (winding-type chip inductor) |
| 31: | Laminated chip |
| 34: | External conductive film |
| 35: | Internal coil |
| 40: | Electronic component (laminated chip inductor) |
| d1: | Long-axis dimension |
| d2: | Short-axis dimension |

DETAILED DESCRIPTION

In the present disclosure, "an oxide layer formed as a result of oxidation of the grain" refers to an oxide layer formed by oxidation greater than natural oxidation of the grain, which oxide layer is an oxide layer grown by reacting a surface of the grain and oxygen by heat treatment of a molded body formed from grains in an oxidizing atmosphere. Also, a "layer" refers to a layer distinguishable from others based on its compositions, structures, properties, appearance, and/or production processes, etc., including a layer having a discrete or unclear boundary, and a layer which is a continuous film on the surface of a grain or which is a film having partially a discontinued portion. In some embodiments, an "oxide layer" is a continuous film covering the entire surface of each grain. Further, such an oxide layer possesses any of the characteristics identified in the present disclosure, and the oxide layer grown by oxidation of the grain surface can be distinguished from an oxide film formed by other methods. In the present disclosure, relative terms such as "greater", "earlier", etc. refer to substantial differences by degrees which cause significant differences in function, structure, or effect/result.

In the present disclosure, depending on the context, the term "invention" refers to an embodiment or embodiments of the invention.

In the present disclosure, disclosed numbers refer to exact numbers or approximate numbers in some embodiments, and the upper and/or lower endpoints of described ranges are/is included in some embodiments, or excluded in some embodiments. Further, in some embodiments, numbers refer to average numbers, representative numbers, median, etc.

In the present disclosure where conditions and/or structures are not specified, a skilled artisan in the art can readily provide such conditions and/or structures, in view of the present disclosure, as a matter of routine experimentation.

In this disclosure, any defined meanings do not necessarily exclude ordinary and customary meanings in some embodiments.

Figure 1:
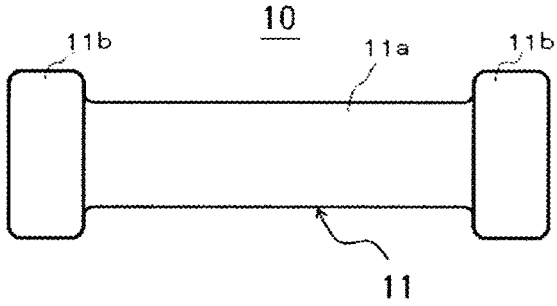
FIG. 1 is a side view showing a first embodiment of a base material using a soft magnetic alloy for an electronic component conforming to the present invention.
Figure 2:
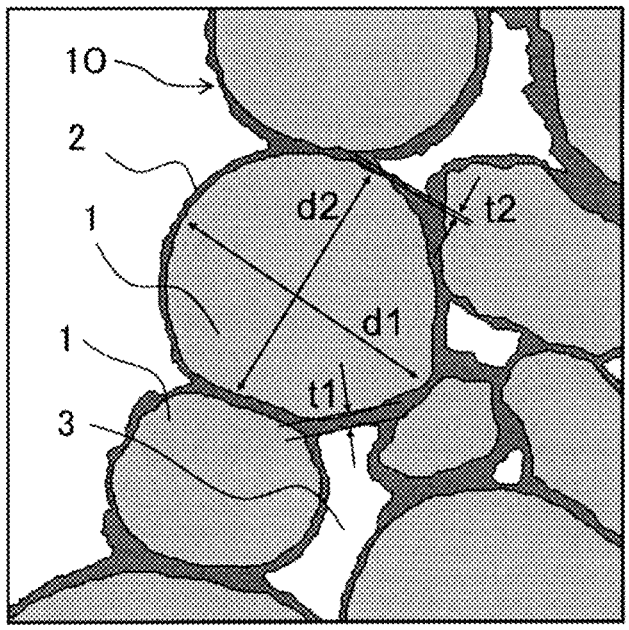
FIG. 2 is an enlarged schematic section view of the base material using a soft magnetic alloy for the electronic component in the first embodiment.

The following explains a first embodiment of a base material using a soft magnetic alloy for an electronic component conforming to the present invention, by referring to FIGS. 1 and 2. FIG. 1 is a side view showing the exterior of a base material 10 using a soft magnetic alloy for the electronic component in this embodiment.

The base material 10 using a soft magnetic alloy for the electronic component in this embodiment is used as a core around which a coil of a coil-type chip inductor is wound. The core 11 has a sheet-shaped winding center 11*a* which is provided in parallel with the mounting surface of a circuit board, etc., and around which a coil is wound, and a pair of flange parts 11*b*, 11*b* provided at the opposing ends of the winding center 11*a*, which has a drum-type appearance. Coil ends are electrically connected to a conductive film 14 formed on the surface of flange parts 11*b*, 11*b*.

The base material 10 using a soft magnetic alloy for the electronic component in this embodiment is constituted by a group of grains of a soft magnetic alloy containing iron (Fe), silicon (Si) and other element that oxidizes more easily than iron, characterized in that an oxide layer is formed on the surface of each soft magnetic grain through oxidization of the grain, that the oxide layer contains more chromium than does the alloy grain, and that grains are bonded with one another via this oxide layer. The descriptions below use element names or element symbols.

FIG. 2 is an enlarged schematic section view of the base material 10 using a soft magnetic alloy for the electronic component in this embodiment. The figure was created based on a composition image obtained by capturing a cross-section of the base material in its thickness direction using a SEM (scanning electron microscope) at a magnification of 3000 times.

In the above schematic view, multiple grains and the oxide layer are identified as follows. First, the base material is polished until its cross-section in a thickness direction cutting across the center of the base material is exposed, and the obtained cross-section is captured with a scanning electron microscope (SEM) at a magnification of 3000 times to obtain a composition image. The scanning electron microscope (SEM) provides a composition image showing areas of different contrasts representing different constituent elements.

Next, pixels of the composition image obtained above are classified into three contrast levels. The contrast ranks are determined in such a way that, among the grains shown in the above composition image whose cross-section outline can be fully observed, those whose simple average size D=(d1+d2)/2 is greater than the average grain size (d50%) of material grains (alloy grains having no oxide layer as an initial material), where d1 and d2 represent the long-axis dimension and short-axis dimension of the cross-section of each grain, respectively, are deemed to be of the center rank of composition contrast, and any part of the above composition image corresponding to this contrast rank is judged as a grain 1. On the other hand, any part whose composition contrast is darker than the above center contrast rank is judged as an oxide layer 2. Desirably, measurement is taken multiple times.

Any part brighter than the above center contrast rank is judged as a void 3.

The thickness of the oxide layer 2 can be obtained as the shortest distance from the interface between the grain and oxide layer 2 to the interface between the oxide layer 2 and the void 3.

The thickness of the oxide layer 2 is obtained specifically as follows. First, a cross-section of the base material 10 is captured in a thickness direction using an SEM (scanning electron microscope) at a magnification of 1000 to 3000 times and the center of gravity of one grain in the obtained composition image is calculated using imaging software, after which a linear analysis is conducted using an EDS (energy diffusion X-ray analyzer), starting from the center of gravity point in a radius direction. Any area whose oxygen concentration is at least three times the oxygen concentration at the center of gravity point is judged as an oxide, and the length from this area to the outer periphery of the grain is measured as the thickness of the oxide layer 2. In the above, considering measuring errors or fluctuations, "three times" is considered to be the threshold indicating a non-oxide layer if the value is less than the threshold, and in practice, the oxide layer may have an oxygen concentration 100 times or more than that in the grain. In some embodiments, the region of the oxide layer can be defined based on an evaluation method selected as necessary from any method disclosure in the present disclosure (distinguishing method based on brightness contrast, distinguishing method based on oxygen concentration, later-described distinguishing method based on composition, later-described distinguishing method based on peak intensity ratio, etc.), and any other conventional methods related to the presence (concentration) of oxygen.

In some embodiments, the average grain size of the soft magnetic grain having an oxide layer is substantially or nearly the same as the average grain size of the material grain (grains prior to molding and heat treatment).

The thickness of the oxide layer 2 formed on the surface of the alloy grain may be caused to vary even on a single alloy grain.

Figure 12:
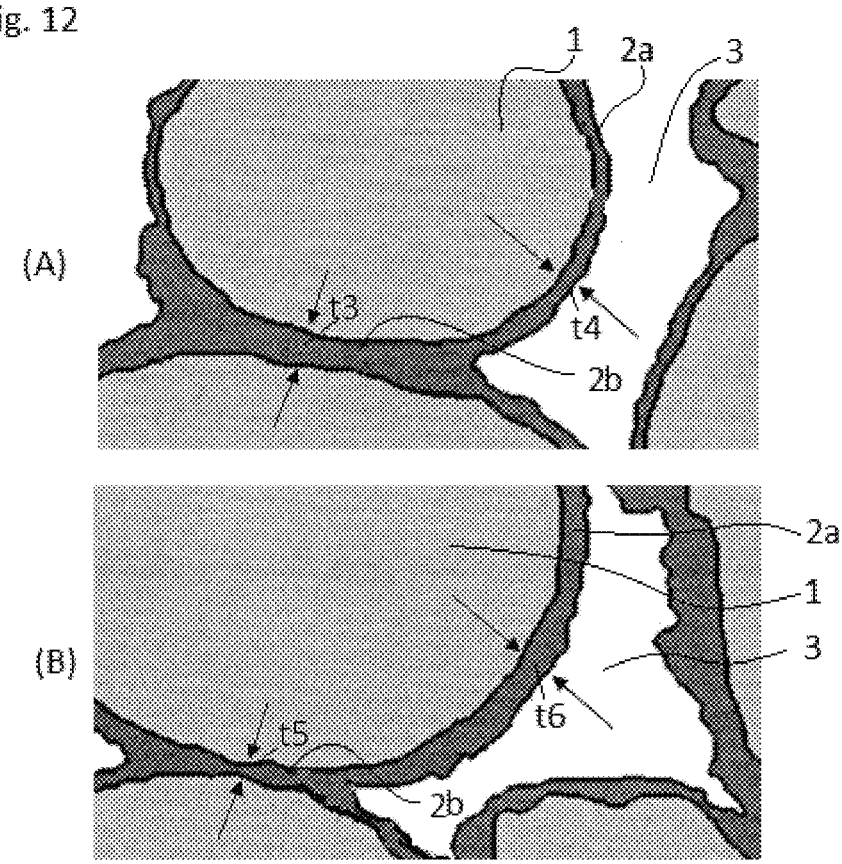
FIG. 12 consists of two enlarged schematic section views (A) and (B) of the base material using a soft magnetic alloy for the electronic component according to embodiments of the present invention.

In an embodiment, as a whole, alloy grains can be bonded via an oxide layer (a "bonding oxide layer") thicker than the oxide layer on the surface of alloy grains (a "surface oxide layer" which is an oxide layer adjoined by a void 3), to achieve high strength. See (A) in FIG. 12 wherein thickness t3 of a bonding oxide layer 2*b* is greater than thickness t4 of a surface oxide layer 2*a*.

In another embodiment, as a whole, alloy grains can be bonded via an oxide layer thinner than the oxide layer on the surface of alloy grains (the oxide layer adjoined by a void 3), to achieve high magnetic permeability. See (B) in FIG. 12 wherein thickness t5 of a bonding oxide layer 2*b* is smaller than thickness t6 of a surface oxide layer 2*a*.

In yet another embodiment, at least some of soft magnetic grains are grains that partially have an oxide layer (as a surface oxide layer) of at least 50 nanometers in thickness.

Figure 4:
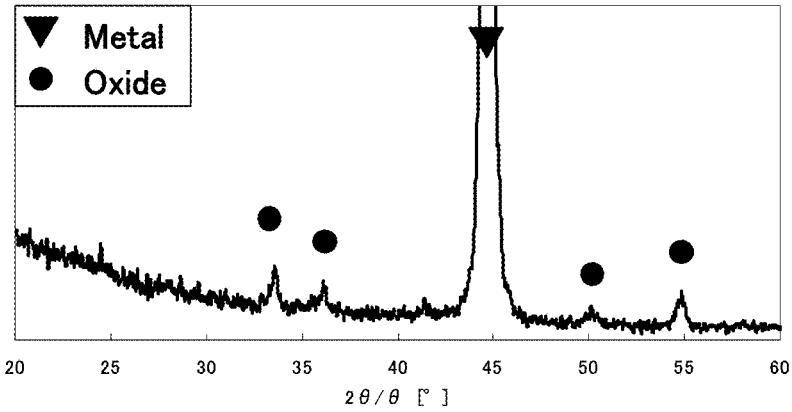
FIG. 4 shows a graph indicating the analysis results, using an X-ray diffraction analyzer, of the oxide layer of the base material using a soft magnetic alloy for the electronic component in the first embodiment.

In another embodiment, the aforementioned oxide layer bonding the aforementioned grains is preferably constituted by a single phase. A "single phase" refers to identical crystals bonded continuously together substantially without voids (other than voids adjoined by the oxide layer), which can be observed inside the oxide layer between grains using a transmission electron microscope (TEM). As shown in FIG. 4, the crystalline structure can also be observed with an X-ray diffraction analyzer.

The structure, composition, and thickness of the oxide layer, as described later, can be controlled by the composition of material grains, the distance between grains (fill ratio), heat treatment temperature, heat treatment duration, oxygen content in a heat treatment atmosphere, etc. The thickness of the oxide layer varies, but in some embodiments, substantially all or most of oxide layers have a thickness of 10 to 200 nm.

In another embodiment, the aforementioned oxide layer preferably includes the first oxide layer where the content of the aforementioned iron component decreases while the content of the aforementioned element that oxidizes easily increases, and the second oxide layer where the content of the aforementioned iron component increases and the content of the aforementioned element that oxidizes easily decreases, as viewed from the aforementioned alloy grain.

It is also preferable that the aforementioned first oxide layer, as viewed from the aforementioned alloy grain, has an inflection point with respect to the content of the aforementioned chromium. The interface between the first and second oxide layers may be discrete or unclear.

Figure 5:
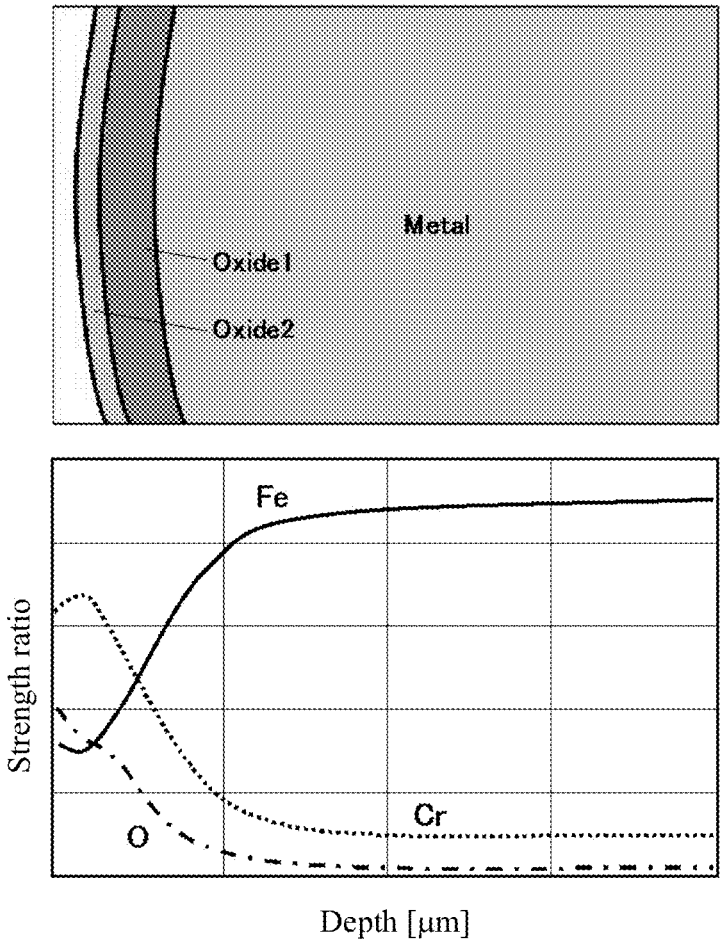
FIG. 5 shows a graph indicating the results of linear energy diffusion X-ray analysis, using a scanning electron microscope, of the base material using a soft magnetic alloy for the electronic component in the first embodiment.

This structure can be observed with an EDS (energy diffusion X-ray analyzer), as shown in FIG. 5, and has the effect of keeping the saturation magnetic flux density from dropping.

The composition ratio of grains in the above base material using a soft magnetic alloy for an electronic component can be checked as follows. First, a material grain is polished until its cross-section cutting across the center of the grain is exposed, and the obtained cross-section is captured with a scanning electron microscope (SEM) at a magnification of 3000 times to obtain a composition image, which is then used to calculate the composition of 1 μm□ near the center of the grain by the ZAF method through energy diffusion X-ray analysis (EDS). Next, the above base material using a soft magnetic alloy for an electronic component is polished until its cross-section in a thickness direction cutting across roughly the center of the base material is exposed, and the obtained cross-section is captured with a scanning electron microscope (SEM) at a magnification of 3000 times to obtain a composition image. Among the grains shown in this composition image whose cross-section outline can be fully observed, a grain is extracted, whose simple average size D=(d1+d2)/2 is greater than the average grain size of material grains (d50%), where d1 and d2 represent the long-axis dimension and short-axis dimension of the cross-section of each grain, respectively, and the composition of 1 $\mu m^2$ near the point of intersection of its long axis and short axis is calculated by the ZAF method through energy diffusion X-ray analysis (EDS). The result is then compared against the composition ratio in the above material grain to show the composition ratio in the alloy grain of the above base material using a soft magnetic alloy for an electronic component. Since the composition of the material grain is known, by comparing the composition ratios determined by the ZAF method, the composition of the alloy grain can be determined.

The thickness of the oxide layer on the above base material using a soft magnetic alloy for an electronic component was determined as the average thickness T=(t1+t2)/2, where t1 represents the thickness of the oxide layer present on the surface of grains 1, 1 identified by the above method, measured at the thickest part farthest away from the grain 1, while t2 represents the thickness at the thinnest part.

An embodiment of the present invention is explained using an example where the element that oxidizes easily is chromium.

The base material 10 using a soft magnetic alloy for the electronic component in this embodiment has multiple grains 1, 1 each containing 2 to 8 percent by weight of chromium, 1.5 to 7 percent by weight of silicon, and 88 to 96.5 percent by weight of iron, and an oxide layer 2 generated on the surface of each grain 1. The oxide layer 2 contains at least iron and chromium, where the peak strength ratio R2 of chromium relative to iron, as measured by energy diffusion X-ray analysis using a transmission electron microscope, is substantially greater than the peak strength ratio R1 of chromium relative to iron in the grain. For example, R2 is at least several times or several tens of times greater than R1. There are also voids 3 between multiple grains.

In the above base material using a soft magnetic alloy for the electronic component, the peak strength ratio R2 of chromium relative to iron in the above oxide layer 2, and strength ratio R1 of chromium relative to iron in the above grain 1, can be respectively obtained as follows. First, SEM-EDS analysis is performed on the above composition image to obtain the composition of 1 $\mu m^2$ around the point of intersection of the long axis d1 and short axis d2 inside the grain 1. Next, SEM-EDS analysis is performed on the above composition image to obtain the composition of 1 $\mu m^2$ around the center point of the oxide layer in a thickness direction in the location where the thickness of the oxide layer corresponds to the average thickness T=(t1+t2)/2, where t1 represents the thickness of the oxide layer 2 on the surface of the grain 1 as measured at the thickest part, while t2 represents the thickness at the thinnest part. Now, the peak strength of chromium relative to iron, or $R1=C1_{CrKa}/C1_{FeKa}$, can be obtained from the strength of iron, or $C1_{FeKa}$, and strength of chromium, or $C1_{CrKa}$, in the grain 1. Also, the peak strength of chromium relative to iron, or $R2=C2_{CrKa}/C2_{FeKa}$, can be obtained from the strength of iron, or $C2_{FeKa}$, and strength of chromium, or $C2_{CrKa}$, at the center point of the oxide layer 2 in a thickness direction.

Also, with the base material using a soft magnetic alloy for an electronic component as proposed by the present invention, bonding of adjacent grains 1, 1 via an oxide layer formed on their surface can be confirmed by a schematic drawing, like the one shown in FIG. 2, created from the above composition image. This bonding of adjacent grains 1, 1 via an oxide layer formed on their surface also manifests as improved magnetic characteristics and strength of the base material using a soft magnetic alloy for an electronic component.

To manufacture the base material using a soft magnetic alloy for an electronic component as proposed by the present invention, one embodiment is that first a thermoplastic resin or other binder is added to material grains containing chromium, silicon and iron, and the mixture is agitated and kneaded to obtain pellets. Next, these pellets are compression-molded to form a molded product, and the obtained molded product is heat-treated at 400 to 900° C. in the standard atmosphere. This heat treatment in the standard atmosphere degreases the thermoplastic resin that has been mixed in, generates an oxide layer constituted by metal oxide on the grain surface while bonding chromium that was present in the grain and has migrated to the surface as a result of heat treatment, with iron and oxygen that are main ingredients of the grain, and also bonds the oxide layers on the surface of adjacent grains. The generated oxide layer (layer of metal oxide) is an oxide constituted primarily by Fe and Cr, which ensures insulation between grains to help provide a base material using a soft magnetic alloy for the electronic component.

Material grains may be those manufactured by the water atomization method, for example, and material grains may have a spherical or flat shape, among others.

Under the present invention, raising the heat treatment temperature in an oxygen atmosphere causes the binder to break down and the soft magnetic alloy to be oxidized. Accordingly, desirable heat treatment conditions for the molded product are such that a temperature between 400 and 900° C. is held for at least 1 minute in the standard atmosphere. As long as heat treatment is applied within this temperature range, an excellent oxide layer can be formed. A more preferable temperature range is 600 to 800° C. Heat treatment may be performed in a condition other than the standard atmosphere, such as in an atmosphere where the oxygen component pressure is equivalent to that in the standard atmosphere. In a reducing atmosphere or non-oxidizing atmosphere, an oxide layer constituted by metal oxide is not formed by heat treatment, resulting in sintering of grains and significant drop in volume resistivity.

The oxygen concentration and amount of steam in an atmosphere are not specifically limited, but desirably the standard atmosphere or dry air is used from the viewpoint of production.

When the heat treatment temperature exceeds 400° C., excellent strength and excellent volume resistivity can be obtained. If the heat treatment temperature exceeds 900° C., on the other hand, the strength will increase but the volume resistivity will drop.

Holding the heat treatment temperature mentioned above for at least 1 minute facilitates the generation of an oxide layer constituted by a metal oxide containing Fe and Cr. Since the thickness of the oxide layer saturates at a specific value, the maximum holding time is intentionally not set. However, 2 hours or less is appropriate in consideration of productivity.

As explained above, a base material using a soft magnetic alloy with an oxide layer, which offers both excellent strength and excellent volume resistivity, can be obtained by adjusting the heat treatment conditions within the above ranges. In other words, the heat treatment temperature, heat treatment time, oxygen content in the heat treatment atmosphere, etc. are used to control the formation of an oxide layer.

With the base material using a soft magnetic alloy for an electronic component as proposed by the present invention, the above treatment is applied to alloy powder constituted by iron, silicon and other element that oxidizes more easily than iron, to achieve high magnetic permeability and high saturation magnetic flux density. Due to this high magnetic permeability, electronic components through which greater current can flow are obtained with a smaller base material using a soft magnetic alloy when compared to the conventional ones.

Unlike a coil device wherein soft magnetic alloy grains are bonded using resin or glass, since neither resin nor glass is used, and application of high pressure is not necessary during molding, low-cost production is possible.

Also with the base material using a soft magnetic alloy for the electronic component in this embodiment, high saturation magnetic flux density is maintained and even after the heat treatment in the standard atmosphere, glass component, etc., will not migrate to the surface of the base material and thus small chip electronic components that offer high dimensional stability can be provided.

Figure 6:
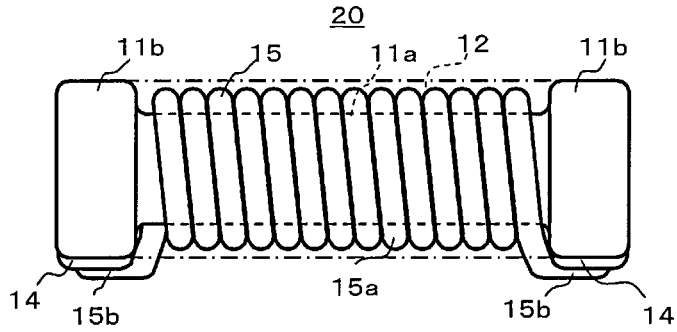
FIG. 6 is a side view, with partial perspective projection, of the first embodiment of a coil-type electronic component under the present invention.
Figure 7:
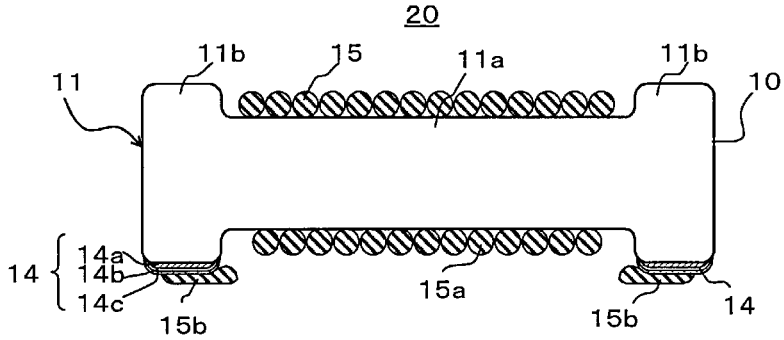
FIG. 7 is a longitudinal section view showing the internal structure of the coil-type electronic component in the first embodiment.

Next, the first embodiment of an electronic component conforming to the present invention is explained by referring to FIGS. 1, 2, 6 and 7. FIGS. 1 and 2 are not explained here, because they were already explained in connection with the earlier embodiment of base material using a soft magnetic alloy for an electronic component. FIG. 6 is a side view, with partial perspective projection, of the electronic component in this embodiment. FIG. 7 is a longitudinal section view showing the internal structure of the electronic component in this embodiment. The electronic component 20 in this embodiment is a coil-type electronic component, or specifically a winding-type chip inductor. It is comprised of a drum-type core 11 constituting the above base material 10 using a soft magnetic alloy for an electronic component, and the aforementioned base material 10, and has a pair of sheet-shaped cores 12, 12 (not illustrated) connecting the two flange parts 11*b*, 11*b* of the drum-type core 11. On the installation surfaces of the flange parts 11, 11*b* of the core 11, a pair of external conductive films 14, 14 are formed, respectively. Also, a coil 15 constituted by an insulation coated conductive wire is wound around the winding center 11*a* of the core 11 to form a winding part 15*a*, while both ends 15*b*, 15*b* are thermo-compression-bonded to the external conductive films 14, 14 on the installation surfaces of the flange parts 11*b*, 11*b*, respectively. The external conductive films 14, 14 each have a baked conductive layer 14*a* formed on the surface of the base material 10, as well as a Ni plating layer 14*b* and Sn plating layer 14*c* that are layered on top this baked conductive layer 14*a*. The aforementioned sheet-shaped cores 12, 12 are bonded by resin adhesive to the flange parts 11*b*, 11*b* of the drum-type core 11.

The electronic component 20 in this embodiment has:

multiple grains containing chromium, silicon and iron;

an oxide layer formed on the surface of these grains, wherein this oxide layer contains at least iron and chromium and whose peak strength ratio of chromium relative to iron is higher than the peak strength ratio of chromium relative to iron in the aforementioned grain, based on calculation by the ZAF method through energy diffusion X-ray analysis using a scanning electron microscope; and a base material 10, as a core 11, which uses the aforementioned soft magnetic alloy for an electronic component where oxide layers formed on the surfaces of the aforementioned grains adjacent to one another are bonded. At least a pair of external conductive layers 14, 14 are formed on the surface of the base material 10. The base material 10 using a soft magnetic alloy for the electronic component, which constitutes the electronic component 20 in this embodiment, is not explained here because it has already been explained earlier.

The core 11 at least has a winding center 11*a*, where the cross-section of the winding center 11*a* may be sheet-shaped (rectangular), circular or oval.

Also, it is desirable that at least one flange part 11 is provided on one end of the aforementioned winding center 11*a*. With a flange part 11, the coil position relative to the winding center 11*a* can be controlled easily using the flange part 11, to help stabilize inductance and other characteristics.

The core 11 can be embodied in several ways, such as an embodiment with one flange part, embodiment with two flange parts (drum core), embodiment where the long-axis direction of the winding center 11*a* is placed vertically to the installation surface, and embodiment where the long-axis direction is placed horizontally to the installation surface.

Among others, an embodiment where a flange part is provided only on one axial end of the winding center 11*a* and the long-axis direction of the winding center 11*a* is placed vertically to the installation surface, is preferable in reducing the height.

The conductive film 14 is formed on the surface of the base material 10 using a soft magnetic alloy for an electronic component, and an end of the coil is connected to the conductive film 14.

The conductive film 14 may be a baked conductive film or resin conductive film. A baked conductive film can be formed on the base material 10 using a soft magnetic alloy for an electronic component by, for example, baking a paste made of silver to which glass has been added at a specified temperature. A resin conductive film can be formed on the base material 10 using a soft magnetic alloy for an electronic component by, for example, applying a paste containing silver and epoxy resin and then treating the paste at a specified temperature. In the case of baked conductive film, heat treatment can be applied after the conductive film has been formed.

The coil may be made of copper or silver. Desirably the coil is given insulation coating.

The coil may be a rectangular wire, angular wire, or rounded wire.

Use of a rectangular or angular wire is desirable because the gaps between windings can be reduced and the electronic component can be kept small.

A specific example of forming the baked conductive layer 14*a* that constitutes the conductive films 14, 14 on the surface of the base material 10 using a soft magnetic alloy for an electronic component in the electronic component 20 in this embodiment, is given below.

Bake-type electrode material paste containing metal grains and glass frit (bake-type Ag paste is used in this example) is applied on the installation surfaces of the flange parts 11*b*, 11*b* of the base material 10, or core 11, and then heat treatment is given in the standard atmosphere to sinter and affix the electrode material directly on the surface of the base material 10. Ni and Sn metal plating layers may also be formed, by means of electrolysis, on the surface of the baked conductive layer 14*a* that has been formed.

The electronic component 20 in this embodiment can also be obtained by the manufacturing method explained below.

Material containing material grains and binder is molded, where the specific composition of material grains is, say, 2 to 8 percent by weight of chromium, 1.5 to 7 percent by weight of silicon and 88 to 96.5 percent by weight of iron, and bake-type electrode material paste containing metal powder and glass frit is applied on the surface of the obtained molded product at least over an area that will become the installation surface, and the resulting molded product is heat-treated at 400 to 900° C. in the standard atmosphere. Metal plating layers may also be formed on the baked conductive layer that has been formed. According to this method, an oxide layer is generated on the surface of grains, and a base material using a soft magnetic alloy for an electronic component where oxide layers on the surfaces of adjacent grains are bonded with one another can be formed simultaneously with a baked conductive layer constituting the conductive film on the surface of this base material, which simplifies the manufacturing process.

Since chromium oxidizes more easily than iron, excessive oxidization of iron can be prevented when heat is applied in an oxidizing atmosphere, compared to pure iron. Other than chromium, aluminum can also be used.

Figure 8:
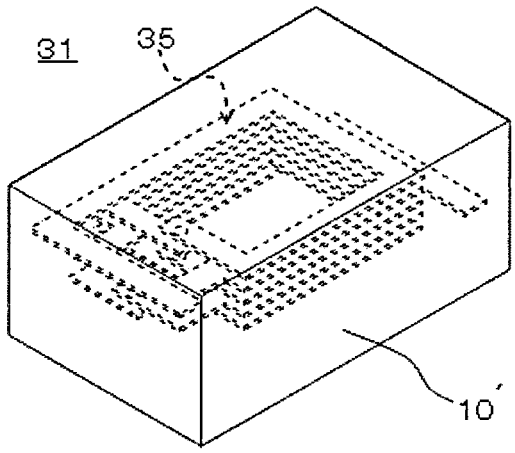
FIG. 8 is a perspective view of internal structure, showing an example of variation of the embodiment of base material using a soft magnetic alloy for an electronic component conforming to the present invention.

Next, an example of variation of the embodiment of the base material using a soft magnetic alloy for an electronic component under the present invention is explained by referring to FIG. 8. FIG. 8 is a perspective view of internal structure, showing an example of variation of the base material 10' using a soft magnetic alloy for an electronic component. The base material 10' in this example of variation has a rectangular solid appearance, while on the inside an internal coil 35 wound in helical manner is buried and the pullout parts at both ends of the internal coil 35 are exposed to a pair of opposing end faces of the base material 10'. The base material 10', together with the internal coil 35 buried inside, constitutes a laminated chip 31. Just like the base material 10 using a soft magnetic alloy for the electronic component in the first embodiment described earlier, the base material 10' using a soft magnetic alloy for the electronic component in this example of variation is also characterized in that it has:

multiple grains containing chromium, silicon and iron;

an oxide layer formed on the surface of these grains, wherein this oxide layer contains at least iron and chromium and whose peak strength ratio of chromium relative to iron is higher than the peak strength ratio of chromium relative to iron in the grain, based on energy diffusion X-ray analysis using a scanning electron microscope, and wherein oxide layers formed on the surfaces of adjacent grains are bonded with one another.

The base material 10' using a soft magnetic alloy for the electronic component in this example of variation also has the same operations and effects as those of the base material 10 using a soft magnetic alloy for the electronic component in the first embodiment described earlier.

Figure 9:
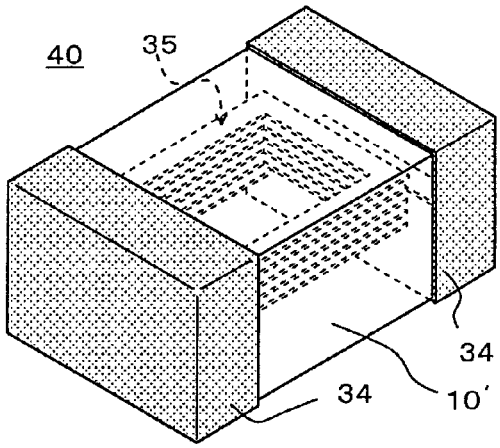
FIG. 9 is a perspective view of internal structure, showing an example of variation of the embodiment of an electronic component under the present invention.

Next, an example of variation of the embodiment of an electronic component under the present invention is explained by referring to FIG. 9. FIG. 9 is a perspective view of internal structure, showing an electronic component 40 being an example of variation. The electronic component 40 in this example of variation is constituted by the base material 10' using a soft magnetic alloy for the electronic component described in the aforementioned example of variation, where a pair of external conductive films 34, 34 are formed on or near a pair of opposing end faces of the base material in a manner connecting the exposed pullout parts of the internal coil 35. These external conductive films 34, 34, while not illustrated, have a baked conductive layer and an Ni plating layer and an Sn plating layer that are layered on top of this baked conductive layer, just like the external conductive layers 14, 14 of the electronic component 20 in the first embodiment described earlier.

In addition, it is desirable that the multiple grains constituting the base material using a soft magnetic alloy for an electronic component, as proposed by the present invention, should have a composition of "2 percent by weight≤Chromium≤8 percent by weight," "1.5 percent by weight≤Silicon≤7 percent by weight" and "88 percent by weight≤Iron≤96.5 percent by weight." When the respective components are within these ranges, the base material using a soft magnetic alloy for an electronic component as proposed by the present invention demonstrates even higher strength and higher volume resistivity.

In general, soft magnetic alloys containing larger amounts of Fe have higher saturation magnetic flux densities and thereby offering better DC superimposition characteristics. However, higher Fe contents mean generation of rust in a condition of high temperature and humidity, which causes various problems in use, such as shedding of rusted material.

It is a well-known fact that adding chromium to magnetic alloys is effective in raising the corrosion resistance of alloys, one representative example of which is stainless steel. However, when compacted powder magnetic cores were made from such magnetic alloy powder containing chromium by applying heat treatment in a non-oxidizing atmosphere, specific resistances measured by an insulation resistance tester were around $10^{-1}$ Ωcm, which is enough to prevent eddy-current loss between grains, but short of $10^5$ Ωcm or more needed to form an external conductive film, and as a result no metal plating layer could be formed on the baked conductive layer constituting the external conductive film.

Accordingly, under the present invention, a molded product containing a binder and material grains having the aforementioned composition is heat-treated in an oxidizing atmosphere to generate on the surface of grains an oxide layer constituted by a metal oxide layer, while causing oxide layers on the surfaces of adjacent grains to be bonded with one another, to achieve high strength. The base material using a soft magnetic alloy for an electronic component, thus obtained, had a greatly improved volume resistivity $\rho_v$ of $10^5$ Ωcm or more, which made it possible to form Ni, Sn and other metal plating layers, without causing plating extension, on the baked conductive layer constituting the external conductive film formed on the surface of the base material.

The reason the composition is limited for the base material using a soft magnetic alloy for an electronic component, in a more favorable form of the present invention, is explained.

If the chromium content in the composition of multiple grains is less than 2 percent by weight, the volume resistivity becomes low and no metal plating layer can be formed, without causing plating extension, on the baked conductive layer constituting the external conductive film.

If chromium is contained by more than 8 percent by weight, the volume resistivity also becomes low and no metal plating layer can be formed, without causing plating extension, on the baked conductive layer constituting the external conductive film.

If an oxide coat is formed using Fe—Si—Al powder via heat treatment in the standard atmosphere, as described in Patent Literature 1 above, the coat is constituted by a chromium-free oxide. As a result, its volume resistivity becomes lower than $10^5$ Ωcm and no metal plating layer can be formed, without causing plating extension, on the baked conductive layer constituting the external conductive film.

With the above base material using a soft magnetic alloy for an electronic component, Si in the composition of multiple grains has the effect of improving the volume resistivity, but this effect is not achieved when the content is less than 1.5 percent by weight, while the achieved effect is not sufficient when the content is more than 7 percent by weight, and the volume resistivity is also less than $10^5$ Ωcm, which means that no metal plating layer can be formed, without causing plating extension, on the baked conductive layer constituting the external conductive film. Si also has the effect of improving the magnetic permeability, but if the content is more than 7 percent by weight, a relative decrease in Fe content causes the saturation magnetic flux density to drop. It also results in lower moldability, which is another factor that lowers the magnetic permeability and the saturation magnetic flux density.

If aluminum is used as the element that oxidizes easily, instead of chromium, a desirable composition is 2 to 8 percent by weight of aluminum, 1.5 to 12 percent by weight of silicon, and 80 to 96.5 percent by weight of iron.

If the aluminum content in the composition of multiple grains is less than 2 percent by weight, the volume resistivity becomes low and no metal plating layer can be formed, without causing plating extension, on the baked conductive layer constituting the external conductive film. If the aluminum content is more than 8 percent by weight, on the other hand, a relative decrease in Fe content causes the saturation magnetic flux density to drop.

From the viewpoint of rust-resistance, a desirable composition is 2 to 8 percent by weight of chromium, 1.5 to 7 percent by weight of silicon, and 88 to 96.5 percent by weight of iron.

It is also possible to mix grains of an alloy of iron, chromium and silicon, with grains of an alloy of iron, aluminum and silicon (in an amount, for example, of less than 50% by weight of the total alloy grains).

In some embodiments, the alloy grains are comprised of, consist essentially of, or consist of iron, chromium, and silicon. In some embodiments, the alloy grains are comprised of, consist essentially of, or consist of iron, aluminum, and silicon. In some embodiments, the alloy grains are comprised of, consist essentially of, or consist of iron, chromium, aluminum, and silicon. In some embodiments, the term "consisting of" does not exclude unavoidable impurities.

With the above base material using a soft magnetic alloy for an electronic component, the saturation magnetic flux density drops, while moldability also drops to decrease the magnetic permeability and saturation magnetic flux density, if the iron content in the composition of multiple grains is less than 88 percent by weight. If the iron content is more than 96.5 percent by weight, the volume resistivity drops due to a relative drop in chromium content and silicon content.

Under the present invention, it is also desirable that the average size of multiple grains is 5 to 30 μm in equivalent average grain size d50% (arithmetic mean) of material grains. Also note that the average size of multiple grains mentioned above can be approximated by a value obtained by capturing a composition image of a cross-section of the base material using a scanning electron microscope (SEM) at a magnification of 3000 times, and then dividing the total sum of simple averages D=(d1+d2)/2 of grains whose cross-section outline can be fully observed, by the total number of grains, where d1 and d2 represent the long-axis dimension and short-axis dimension of the cross-section of each grain, respectively.

The group of alloy metal grains has a granular distribution, and grains are not necessarily circular but have irregular shapes instead. When solid alloy metal grains are observed two-dimensionally (on a plane), their size varies depending on which cross-section is observed.

Accordingly, under the present invention, the average grain size is evaluated by measuring more grains.

In this sense, it is desirable to measure at least 100 applicable grains under the conditions specified below.

The specific method is as follows. First the largest diameter of the grain cross-section represents the long axis, and the point that equally divides the length of the long axis is obtained. Next, the smallest diameter of the grain cross-section that includes this point represents the short axis. The two are defined as the long-axis dimension and short-axis dimension, respectively.

Grains to be measured are arranged sequentially from the one having the largest diameter of its cross-section, and measurement is performed until the cumulative ratio of grain cross-sections accounts for 95% of all area shown in the scanning electron microscope (SEM) image excluding grains whose cross-section outline is cannot be fully observed, voids, and oxide layers.

As long as the average grain size mentioned above is within the specified range, high saturation magnetic flux density (1.4 T or more) and high magnetic permeability (27 or more) can be obtained, and generation of eddy-current loss in the grain can be prevented even at frequencies of 100 kHz and above.

EXAMPLES

The following explains the present invention in greater detail using examples and a comparative example. It should be noted, however, that the present invention is not at all limited to these examples and the comparative example.

To determine the level of magnetic characteristics of each base material using a soft magnetic alloy for an electronic component, grain materials were molded into a toroidal shape of 14 mm in outer diameter, 8 mm in inner diameter and 3 mm in thickness by adjusting the molding pressure to between 6 and 12 tons/cm$^2$ so that the fill ratio of material grains would become 80 percent by volume, after which the molded product was heat-treated in the standard atmosphere and a coil constituted by urethane-coated copper wire of 0.3 mm in diameter was wound around the obtained base material by 20 turns to obtain a test sample. Saturation magnetic flux density Bs was measured with a vibration sample magnetometer (VSM manufactured by Toei Industry), while magnetic permeability μ was measured with an L chromium meter (4285A manufactured by Agilent Technologies) at a measurement frequency of 100 kHz.

Samples whose saturation magnetic flux density Bs was 0.7 T or more were considered of good quality.

Samples whose magnetic permeability μ was 20 or more were considered of good quality.

To determine the level of strength of each base material using a soft magnetic alloy for an electronic component, 3-point bending rupture stress was measured, as follows, according to the measurement method illustrated in FIG. 10. Each test piece used for measurement of 3-point bending rupture stress was prepared by molding material grains into a sheet shape of 50 mm in length, 10 mm in width and 4 mm in thickness by adjusting the molding pressure to between 6 and 12 tons/cm$^2$ so that the fill ratio of material grains would become 80 percent by volume, and then heat-treating the molded product in the standard atmosphere.

Samples whose 3-point bending rupture stress was 1.0 kgf/mm$^2$ or more were considered of good quality.

Overall, samples whose saturation magnetic flux density Bs, magnetic permeability μ and 3-point bending rupture stress were all of good quality, were considered acceptable.

Figure 10:
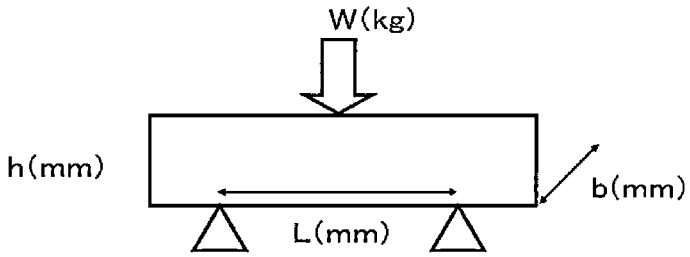
FIG. 10 is an explanation drawing showing how samples were measured for 3-point bending rupture stress in examples of the present invention.
Figure 11:
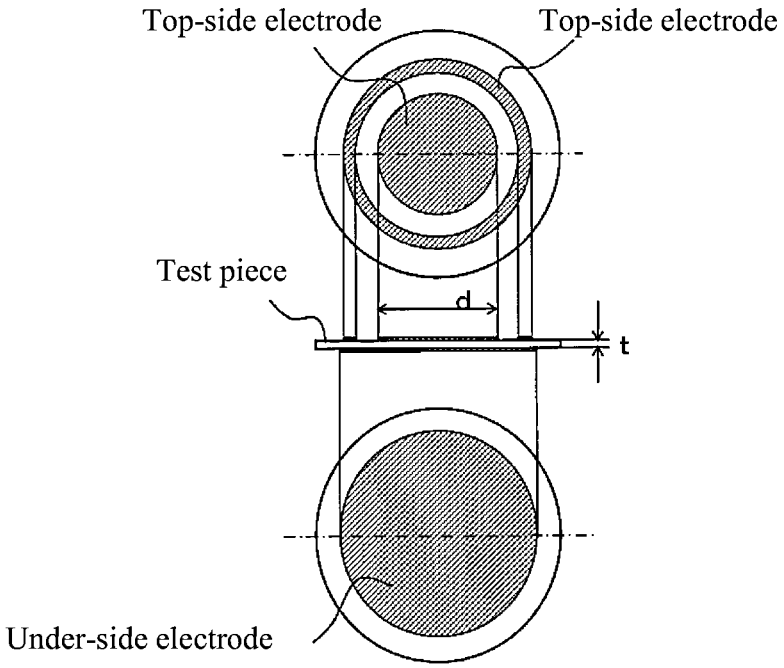
FIG. 11 is an explanation drawing showing how samples were measured for volume resistivity in examples of the present invention.

In addition, to determine the level of volume resistivity of each base material using a soft magnetic alloy for an electronic component, measurement was performed, as shown in FIG. 10, according to JIS-K6911. Each test piece used for measurement of volume resistivity was prepared by molding material grains into a disk shape of 100 mm in diameter and 2 mm in thickness by adjusting the molding pressure to between 6 and 12 tons/cm$^2$ so that the fill ratio of material grains would become 80 percent by volume, and then heat-treating the molded product in the standard atmosphere.

Samples whose volume resistivity was $1\times10^{-3}$ Ωcm or more were considered of acceptable quality, $1\times10^{-1}$ Ωcm or more of good quality, and $1\times10^{5}$ Ωcm or more of excellent quality.

As long as the volume resistivity is $1\times10^{-1}$ Ωcm or more, loss due to eddy current can be kept small when used at high frequencies. If the volume resistivity is $1\times10^{5}$ Ωcm or more, metal plating layers can be formed on top of the conductive layer by wet plating.

Furthermore, to determine the level of formability of metal plating layers on the baked conductive layer constituting the external conductive film on the surface of the base material using a soft magnetic alloy for an electronic component, a drum-type base material is used in the following examples for the base material using a soft magnetic alloy for an electronic component, in terms of the base material shape.

To determine the level of formability of metal plating layers on the external conductive film on the obtained electronic component sample, appearance of samples was visually examined using a magnifying glass and those having Ni and Sn plating layers formed continuously on the baked conductive layer without the plating extending from the baked conductive layer into surrounding areas were considered acceptable (O), and others were considered unacceptable (X).

Example 1

For the material grains to obtain a base material using a soft magnetic alloy for an electronic component, alloy powder (PF-20F manufactured by Epson Atmix) was used which is a type of water-atomized powder whose average grain size (d50%) is 10μ and composition ratio was 5 percent by weight of chromium, 3 percent by weight of silicon and 92 percent by weight of iron. The average grain size d50% of material grains described above was measured using a granularity analyzer (9320HRA manufactured by Nikkiso). Each of the above grains was polished until its cross-section in a thickness direction cutting across roughly the center of the grain was exposed, and the obtained cross-section was captured with a scanning electron microscope (SEM: S-4300SE/N manufactured by Hitachi High-Technologies) at a magnification of 3000 times to obtain a composition image, which was then used to calculate the composition of 1 $\mu m^2$ near the center of the grain and also near the surface by the ZAF method through energy diffusion X-ray analysis (EDS), confirming that the above composition ratio near the center of the grain was roughly the same as the corresponding composition ratio near the surface.

Next, the above grains were mixed with polyvinyl butylal (S-LEC BL, a solution with a solid concentration of 30 percent by weight, manufactured by Sekisui Chemical) using a wet-type rolling agitator to obtain pellets.

The obtained pellets were molded into an angular sheet shape of 50 mm in length, 10 mm in width and 4 mm in thickness; a disk shape of 100 mm in diameter and 2 mm in thickness; a toroidal shape of 14 mm in outer diameter, 8 mm in inner diameter and 3 mm in thickness; a drum-type core having angular flange parts (1.6 mm wide×0.6 mm high×0.3 mm thick) at both ends of winding core parts (60 mm wide× 0.36 mm high, ×1.4 mm long); and a pair of sheet-shaped cores (2.0 mm long×0.5 mm wide, ×0.2 mm thick), by adjusting the molding pressure to between 6 and 12 tons/$cm^2$ so that the fill ratio of multiple grains would become 80 percent by volume.

The disk-shaped molded product, toroidal molded product, drum-type molded product and pair of sheet-shaped molded products, as obtained above, were heat-treated at 700° C. for 60 minutes in the standard atmosphere.

The disk-shaped base material obtained by heat-treating the above disk-shaped molded product was measured for volume resistivity according to JIS-K6911, and the result is shown in Table 1.

Also, the drum-type base material obtained by heat-treating the above drum-type molded product was polished until its cross-section in thickness direction cutting across roughly the center of the winding center was exposed, and the obtained cross-section was captured with a scanning electron microscope (SEM) at a magnification of 3000 times to obtain a composition image. Next, pixels of the composition image obtained above were classified into three contrast levels. The contrast ranks were determined in such a way that, among the grains shown in the above composition image whose cross-section outline could be fully observed, those whose simple average size D=(d1+d2)/2 was greater than the average grain size of material grains (d50%), where d1 and d2 represent the long-axis dimension and short-axis dimension of the cross-section of each grain, respectively, were deemed to be of the center rank of composition contrast, and any part of the above composition image corresponding to this contrast rank was judged as a grain 1. On the other hand, any part whose composition contrast was darker than the above center contrast rank was judged as an oxide layer 2. In addition, any part brighter than the above center contrast rank was judged as a void 3. The obtained result is shown by a schematic drawing in FIG. 2.

Next, among the grains shown in this composition image whose cross-section outline could be fully observed, a grain whose simple average size D=(d1+d2)/2 was greater than the average grain size of material grains (d50%), where d1 and d2 represent the long-axis dimension and short-axis dimension of the cross-section of each grain, respectively, was extracted and the composition of 1 $\mu m^2$ near the point of intersection of its long axis and short axis was calculated by the ZAF method through energy diffusion X-ray analysis (EDS). The result was then compared against the composition ratio of the above material grain to confirm that the composition ratio of multiple grains constituting the above base material was roughly or substantially the same as the composition ratio of material grains.

Figure 3:
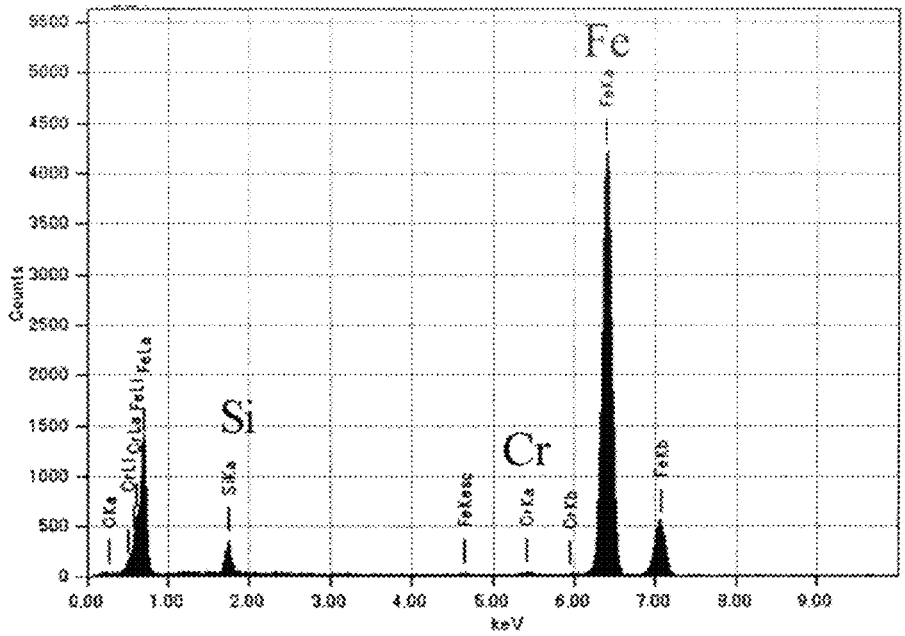
FIG. 3 shows graphs indicating the results of energy diffusion X-ray analysis, using a scanning electron microscope, of the base material using a soft magnetic alloy for the electronic component in the first embodiment. ((A) shows the results of grain; (B) shows the results of oxide layer).
Figure 3:
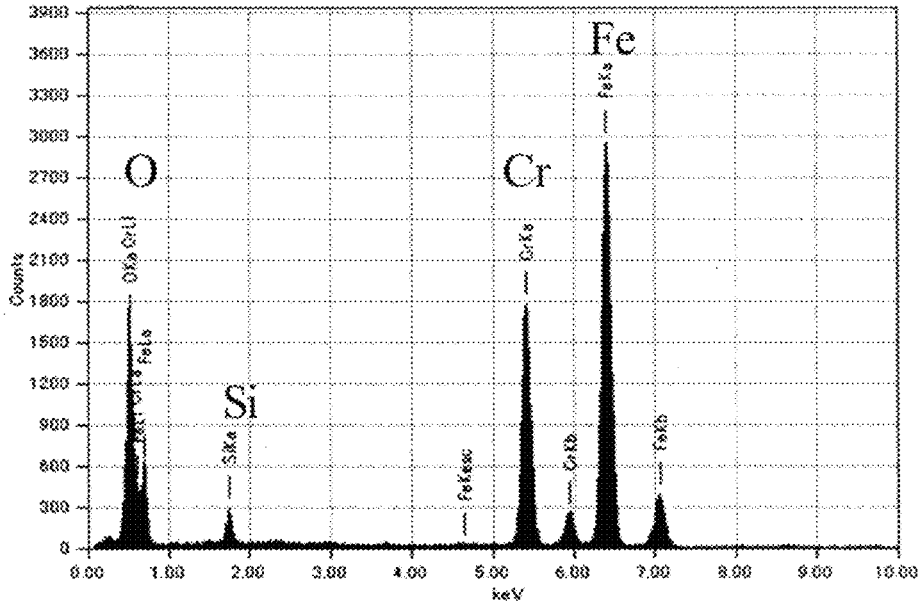

Next, SEM-EDS analysis was performed on the above composition image to obtain the composition of 1 $\mu m^2$ around the point of intersection of the long axis d1 and short axis d2 inside the grain 1, and the result is shown in FIG. 3(A). Then, SEM-EDS analysis was performed on the above composition image to obtain the composition of 1 $\mu m^2$ around the center point of the oxide layer in a thickness direction in the location where the thickness of the oxide layer corresponded to the average thickness T=(t1+t2)/2, where t1 represents the thickness of the oxide layer 2 on the surface of the grain 1 as measured at the thickest part, while t2 represents the thickness at the thinnest part, and the result is shown in FIG. 3(B). From FIG. 3(A), the strength of iron in the grain 1, or $C1_{FeKa}$, is 4200 count, the strength of chromium $C1_{CrKa}$ is 100 count, and the peak strength ratio of chromium relative to iron, or $R1=C1_{CrKa}/C1_{FeKa}$, is 0.024. From FIG. 3(B), the strength of iron at the center point of the oxide layer 2 in a thickness direction, or $C2_{FeKa}$, is 3000 count, the strength of chromium $C2_{CrKa}$ is 1800 count, and the peak strength ratio of chromium relative to iron, or $R2=C2_{CrKa}/C2_{FeKa}$, is 0.60, which is higher than R1 indicating the peak strength ratio of chromium relative to iron in the aforementioned grain.

Also with the base material using a soft magnetic alloy for an electronic component under the present invention, it could be confirmed from the schematic drawing in FIG. 2 derived from the above composition image, that oxide layers 2, 2 formed on the surfaces of adjacent grains 1, 1 were bonded with one another.

The above results confirmed that the base material using a soft magnetic alloy for an electronic component in Example 1 had multiple grains 1, 1 containing 2 to 8 percent by weight of chromium, 1.5 to 7 percent by weight of silicon and 88 to 96.5 percent by weight of iron, and an oxide layer generated on the surface of each grain 1, wherein the oxide layer contained at least iron and chromium and its peak strength ratio of chromium relative to iron was higher than the peak strength ratio of chromium relative to iron in the grain, based on energy diffusion X-ray analysis using a transmission electron microscope.

In addition, a coil constituted by urethane-coated copper wire of 0.3 mm in diameter was wound by 20 turns around the toroidal base material obtained by heat-treating the above toroidal molded product, to obtain a test sample. Saturation magnetic flux density Bs was measured with a vibration sample magnetometer (VSM manufactured by Toei Industry), while magnetic permeability μ was measured with an LCR meter (4285A manufactured by Agilent Technologies) at a measurement frequency of 100 kHz. The obtained results are shown in Table 1.

Furthermore, the angular sheet-shaped molded product obtained above was heat-treated in the standard atmosphere for 60 minutes at 150° C., 200° C., 300° C., 500° C., 600° C., 700° C., 800° C. and 1000° C., respectively, and then the obtained angular sheet-shaped base materials, as well as angular sheet-shaped molded product that was let to stand at room temperature, were measured for 3-point bending rupture stress. The results are shown in Tables 1 and 2.

Also, bake-type Ag conductive film paste was applied on the installation surfaces of the two flange parts of the above drum-type base material, after which the conductive film material was baked by heating up to 700° C. in the standard atmosphere over a period of approx. 30 minutes, holding at 700° C. for 10 minutes, and then lowering the temperature over a period of 30 minutes, to form a baked conductive layer constituting an external conductive film. This was followed by formation of Ni (2 μm in thickness) and Sn (7 μm in thickness) on the surface of this conductive film via the electrolytic plating method.

The obtained results are shown in Table 1.

All of the results of measurement and judgment were favorable, with the strength of the base material being 7.4 kgf/mm$^2$, magnetic characteristics being 1.51 T in saturation magnetic flux density Bs and 45 in magnetic permeability μ, volume resistivity being $4.2\times10^5$ Ωcm, and formability of metal plating layer being ○. Note that magnetic permeability μ was also measured before the heat treatment. The result is shown in Table 3.

Next, a coil constituted by insulation-coated conductive wire was wound around the winding center of the above drum-type base material and both ends were thermo-compression-bonded to the above external conductive film, respectively, after which the base material obtained by heat-treating the above sheet-shaped molded product was bonded via resin adhesive to both sides of the flange parts of the above drum-type base material, to obtain a winding-type chip inductor.

Example 2

Evaluation samples were created in the same manner as in Example 1, except that the composition ratio of material grains was changed to 3 percent by weight of chromium, 5 percent by weight of silicon and 92 percent by weight of iron. The obtained results are shown in Tables 1 and 2.

As shown in Tables 1 and 2, all of the results of measurement and judgment were favorable, as in Example 1, with the magnetic characteristics being 1.46 T in saturation magnetic flux density Bs and 43 in magnetic permeability μ, strength of the base material being 2.8 kgf/mm$^2$, volume resistivity being $2.0\times10^5$ Ωcm, and formability of metal plating layer being ○, SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 3

Evaluation samples were created in the same manner as in Example 1, except that the average grain size (d50%) of material grains was changed to 6 μm. The obtained results are shown in Tables 1 and 2.

As shown in Tables 1 and 2, all of the results of measurement and judgment were favorable, as in Example 1, with the magnetic characteristics being 1.45 T in saturation magnetic flux density Bs and 27 in magnetic permeability μ, strength of the base material being 6.6 kgf/mm$^2$, volume resistivity being $3.0\times10^5$ Ωcm, and formability of metal plating layer being ○. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 4

Evaluation samples were created in the same manner as in Example 1, except that the average grain size (d50%) of material grains was changed to 3 μm. The obtained results are shown in Tables 1 and 2.

As shown in Tables 1 and 2, all of the results of measurement and judgment were favorable, as in Example 1, with the magnetic characteristics being 1.38 T in saturation magnetic flux density Bs and 20 in magnetic permeability μ, strength of the base material being 7.6 kgf/mm$^2$, volume resistivity being $7.0\times10^5$ Ωcm, and formability of metal plating layer being ○. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 5

Evaluation samples were created in the same manner as in Example 1, except that the composition ratio of material grains was changed to 9.5 percent by weight of chromium, 3 percent by weight of silicon and 87.5 percent by weight of iron. The obtained results of measurement and judgment are shown in Tables 1 and 2. As shown in Tables 1 and 2, the magnetic characteristics were 1.36 T in saturation magnetic flux density Bs and 33 in magnetic permeability μ, strength of the base material was 7.4 kgf/mm$^2$, volume resistivity was $4.7\times10^{-3}$ Ωcm, and formability of metal plating layer was X. From this example, it was found that the volume resistivity would drop if the chromium content exceeds 8 percent by weight. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 6

Evaluation samples were created in the same manner as in Example 1, except that the composition ratio of material grains was changed to 5 percent by weight of chromium, 1 percent by weight of silicon and 94 percent by weight of iron. The obtained results of measurement and judgment are shown in Tables 1 and 2. As shown in Tables 1 and 2, the magnetic characteristics were 1.58 T in saturation magnetic flux density Bs and 26 in magnetic permeability μ, strength of the base material was 18 kgf/mm$^2$, volume resistivity was $8.3\times10^{-3}$ Ωcm, and formability of metal plating layer was X. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 7

Inductors were obtained in the same manner as in Example 1, except that the treatment temperature in the standard atmosphere was changed to 1000° C. The obtained results of measurement and judgment are shown in Table 1.

As shown in Tables 1 and 2, the magnetic characteristics were 1.50 T in saturation magnetic flux density Bs and 50 in magnetic permeability μ, strength of the base material was 20 kgf/mm$^2$, volume resistivity was $2.0\times10^2$ Ωcm, and formability of metal plating layer was X. In this reference example where the heat treatment temperature was raised, the 3-point bending rupture stress was higher, but the volume resistivity was lower, compared to Example 1. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Example 8

Evaluation samples were created in the same manner as in Example 1, except that the composition ratio of material grains was changed to 9.5 percent by weight of silicon, 5.5 percent by weight of aluminum and 85 percent by weight of iron. The obtained results of measurement and judgment are shown in Tables 1 and 2. As shown in Tables 1 and 2, the magnetic characteristics were 0.77 T in saturation magnetic flux density Bs and 32 in magnetic permeability μ, strength of the base material was 1.4 kgf/mm$^2$, volume resistivity was $8.0\times10^3$ Ωcm, and formability of metal plating layer was X. The volume resistivity was low and no metal plating layer could be formed on the baked conductive layer constituting the external conductive film. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here aluminum) by a quantity larger than that in the alloy grains.

Comparative Example 1

Evaluation samples were created in the same manner as in Example 1, except that the composition ratio of material grains was changed to 1 percent by weight of chromium, 6.5 percent by weight of silicon and 92.5 percent by weight of iron. The obtained results of measurement and judgment are shown in Tables 1 and 2.

As shown in Tables 1 and 2, the magnetic characteristics were 1.36 T in saturation magnetic flux density Bs and 17 in magnetic permeability μ, strength of the base material was 4.2 kgf/mm$^2$, volume resistivity was $4.9\times10^1$ Ωcm, and formability of metal plating layer was X. In this comparative example where the Cr content was less than 2 percent by weight based on the result of SEM-EDS analysis, the metal oxide layer generated on the surfaces of grains by the heat treatment was not an oxide containing an element that oxidizes more easily than iron (here chromium) by a quantity larger than that in the alloy grains, which resulted in the low volume resistivity.

Reference Example 1

Evaluation samples were created in the same manner as in Example 1, except that heat treatment was not performed. The obtained results of measurement and judgment are shown in Tables 1 and 2. As shown in Tables 1 and 2, the magnetic characteristics were 1.50 T in saturation magnetic flux density Bs and 35 in magnetic permeability μ, strength of the base material was 0.54 kgf/mm$^2$, and volume resistivity was $1.4\times10^5$ Ωcm. Note that in this reference example, no sample was created or evaluated with regards to formability of a metal plating layer. The result of SEM-EDS analysis found that no metal oxide layer was generated on the surface of grains in this reference example. This explains why the volume resistivity was slightly lower than that in the examples.

Reference Example 2

Evaluation samples were created in the same manner as in Example 1, except that the temperature of heat treatment in the standard atmosphere was changed to 300° C. The obtained results of measurement and judgment are shown in Tables 1 and 2. As shown in Tables 1 and 2, the magnetic characteristics were 1.50 T in saturation magnetic flux density Bs and 35 in magnetic permeability μ, strength of the base material was 0.83 kgf/mm$^2$, and volume resistivity was $1.4\times10^5$ Ωcm. Note that in this reference example, no sample was created or evaluated with regards to formability of a metal plating layer.

In this reference example, SEM-EDS analysis confirmed that an oxide layer constituted by metal oxide was not sufficiently formed on the surfaces of the grains, because the heat treatment temperature was lower than 400° C. This explains why the volume resistivity was slightly lower than that in the examples.

Example 9

Next, an example of laminated type is given.

Using the same alloy grains in Example 1, a coil-type electronic component was created which had 20 layers, a shape of 3.2 mm×1.6 mm×0.8 mm in size, and a coil inside the base material.

First, a mixture containing 85 percent by weight of alloy metal grains, 13 percent by weight of butyl carbitol (solvent) and 2 percent by weight of polyvinyl butylal (binder) was processed into a sheet shape of 40 μm in thickness using a die-coater, after which conductive paste containing 85 percent by weight of Ag grains, 13 percent by weight of butyl carbitol (solvent) and 2 percent by weight of polyvinyl butylal (binder) was applied on the sheet to form conductive patterns.

Next, sheets on which conductive patterns were formed, each produced as above, were stacked on top of each other and pressed under a pressure of 2 tons/cm$^2$ to obtain a laminate.

The laminate was heat-treated at 800° C. for 2 hours in the standard atmosphere to obtain a base material.

Paste containing Ag was then applied on the based material in which a coil had been formed inside, specifically on the surfaces where the coil's pullout parts were exposed and also on the installation surfaces, after which the base material was heat-treated at 700° C. for 10 minutes to obtain a coil-type electronic component with a metal plating layer that had been formed.

The magnetic characteristics were 1.41 T in saturation magnetic flux density Bs and 15 in magnetic permeability μ. The magnetic permeability μ was 13 before the heat treatment.

Ni was used to form the metal plating layer. SEM-EDS analysis confirmed that the grains were bonded with one another via the metal oxide (oxide layer) formed on the surfaces of the grains by the heat treatment, and the oxide layer was an oxide containing an element that oxidizes more easily than iron (here chromium) by a quantity larger than that in the alloy grains.

Additionally, it was confirmed that in Examples 1 to 4, there were grains wherein the thickness of an oxide layer bonding the grains with one another was thicker than that of an oxide layer on the surfaces of the alloy grains. It was confirmed that in Examples 5 and 6, there were grains wherein the thickness of an oxide layer bonding the grains with one another was thinner than that of an oxide layer on the surfaces of the alloy grains. It was confirmed that in Examples 1 to 8, there were grains wherein the thickness of an oxide layer was 50 nanometers or greater.

TABLE 1

| | Composition [wt %] | | | | Grain size | Heat treatment temperature | | | 3-point bending rupture stress | Volume resistivity | Formability of metal plating |
|---|---|---|---|---|---|---|---|---|---|---|---|
| | Cr | Si | Al | Fe | d50 [um] | [° C.] | Bs [T] | μ | [kgf/mm2] | [Ωcm] | layer |
| Example 1 | 5 | 3 | — | 92 | 10 | 700 | 1.51 | 45 | 7.4 | $4.2 \times 10^5$ | ○ |
| Example 2 | 3 | 5 | — | 92 | 10 | 700 | 1.46 | 43 | 2.8 | $2.0 \times 10^5$ | ○ |
| Example 3 | 5 | 3 | — | 92 | 6 | 700 | 1.45 | 27 | 6.6 | $3.0 \times 10^5$ | ○ |
| Example 4 | 5 | 3 | — | 92 | 3 | 700 | 1.38 | 20 | 7.6 | $7.0 \times 10^5$ | ○ |
| Example 5 | 9.5 | 3 | — | 87.5 | 10 | 700 | 1.36 | 33 | 7.4 | $4.7 \times 10^{-3}$ | x |
| Example 6 | 5 | 1 | — | 94 | 10 | 700 | 1.58 | 26 | 18 | $8.3 \times 10^{-3}$ | x |
| Example 7 | 5 | 3 | — | 92 | 10 | 1000 | 1.50 | 50 | 20 | $2.0 \times 10^2$ | x |
| Example 8 | — | 9.5 | 5.5 | 85 | 10 | 700 | 0.77 | 32 | 1.4 | $8.0 \times 10^3$ | x |
| Comparative Example 1 | 1 | 6.5 | — | 92.5 | 10 | 700 | 1.36 | 17 | 4.2 | $4.9 \times 10^1$ | x |
| Reference Example 1 | 5 | 3 | — | 92 | 10 | — | 1.50 | 35 | 0.54 | $1.4 \times 10^5$ | — |
| Reference Example 2 | 5 | 3 | — | 92 | 10 | 300 | 1.50 | 35 | 0.83 | $1.4 \times 10^5$ | — |

TABLE 2

Heat Treatment Temperatures and 3-point Bending Rupture Stresses [kgf/mm2]

| Heat treatment temperature [° C.] | Example 1 | Example 2 | Example 3 | Example 4 | Example 5 | Example 6 | Example 8 | Comparative Example 1 |
|---|---|---|---|---|---|---|---|---|
| 25 | 0.54 | 0.48 | 0.51 | 0.52 | 0.48 | 0.53 | 0.25 | 0.55 |
| 150 | 1.1 | 1.2 | 1.1 | 1.3 | 1.0 | 1.3 | 0.89 | 1.2 |
| 200 | 0.45 | 0.31 | 0.42 | 0.55 | 0.48 | 0.72 | 0.19 | 0.58 |
| 300 | 0.83 | 0.72 | 0.90 | 1.01 | 0.92 | 0.92 | 0.23 | 0.82 |
| 500 | 3.4 | 1.2 | 2.0 | 3.7 | 3.6 | 5.7 | 0.26 | 2.4 |
| 600 | 4.5 | 1.7 | 3.5 | 5.1 | 4.9 | 8.0 | 0.43 | 3.9 |
| 700 | 7.4 | 2.8 | 6.6 | 7.6 | 7.4 | 18 | 1.4 | 4.2 |
| 800 | 12 | 4.5 | 10 | 16 | 17 | 24 | 5.7 | 6.5 |
| 1000 | 20 | 7.3 | 15 | 27 | 28 | 33 | 7.8 | 8.2 |

* The heat treatment temperature of 1000° C. in Example 1 corresponds to the heat treatment temperature used in Example 7.

TABLE 3

Heat Treatment Temperatures and μ

| Heat treatment temperature [° C.] | Example 1 | Example 2 | Example 3 | Example 4 | Example 5 | Example 6 | Example 8 | Comparative Example 1 |
|---|---|---|---|---|---|---|---|---|
| 25 | 35 | 32 | 23 | 19 | 28 | 23 | 24 | 30 |
| 700 | 45 | 43.0 | 27 | 20 | 33 | 26 | 32 | 17 |
| Δμ | 29 | 36 | 17 | 7 | 18 | 13 | 33 | −43 |

Δμ = (μ at heat treatment temperature 700° C. − μ at heat treatment temperature 25° C.)/μ at heat treatment temperature 25° C. × 100

A base material using a soft magnetic alloy for an electronic component conforming to the present invention, as well as an electronic component made of such base material, are ideally suited to compact electronic components that can be installed on the surface of a circuit board. In particular, they are ideally suited to the size reduction of power inductors through which high current flows.

The present application claims priority to Japanese Patent Application No. 2003-304501, filed Aug. 28, 2003, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil-type electronic component having a coil provided inside or on a surface of a base material, wherein:

the base material is constituted by a group of grains of a soft magnetic alloy containing iron, silicon and chromium that oxidizes more easily than iron;

the surface of each soft magnetic alloy grain has an oxide layer formed on its surface as a result of oxidization of the grain by heat treatment in an atmosphere containing oxygen;

the oxide layer contains more chromium than does the alloy grain; and the grains are bonded with one another via the oxide layer, wherein the oxide layer includes in this order a first oxide layer where the content of the iron component decreases while the content of chromium that oxidizes easily increases, and a second oxide layer where the content of the iron component increases and the content of chromium that oxidizes easily decreases, as viewed outwardly from the soft magnetic alloy grain.

2. A coil-type electronic component according to claim 1, wherein the soft magnetic alloy has a composition of 2 to 8 percent by weight of chromium, 1.5 to 7 percent by weight of silicon, and 88 to 96.5 percent by weight of iron.

3. A coil-type electronic component according to claim 1, wherein the oxide layer via which the soft magnetic alloy grains are bonded with one another is thicker than an oxide layer, other than the bonding oxide layer, on the surface of the soft magnetic alloy grains.

4. A coil-type electronic component according to claim 1, wherein the oxide layer via which the soft magnetic alloy grains are bonded with one another is thinner than an oxide layer, other than the bonding oxide layer, on the surface of the soft magnetic alloy grains.

5. A coil-type electronic component according to claim 1, wherein the oxide layer formed on at least some of the soft magnetic grains has a thickness of at least 50 nanometers.

6. A coil-type electronic component according to claim 1, wherein the oxide layer via which the grains are bonded with one another is of the same phase.

7. A coil-type electronic component according to claim 1, wherein the average size of the soft magnetic grains based on arithmetic mean is 30 micrometers or less.

8. A coil-type electronic component according to claim 1, wherein the first oxide layer, as viewed outwardly from the soft magnetic alloy grain, has an inflection point with respect to the content of chromium.

9. A coil-type electronic component according to claim 1, wherein the oxide layer has a peak strength ratio of chromium which is higher than the peak strength ratio of chromium in the grain, based on calculation by the ZAF method through energy diffusion X-ray analysis using a scanning electron microscope.

10. A coil-type electronic component according to claim 1, wherein the coil has its end electrically connected to a conductive film formed on a surface of the base material.

11. A coil-type electronic component according to claim 1, wherein the coil is a coil conductor formed inside the base material.

12. A coil-type electronic component according to claim 11, wherein the coil conductor forms conductive patterns and is a conductor sintered simultaneously with the base material.

* * * * *